United States Patent [19]

Petrie

[11] Patent Number: 4,850,736

[45] Date of Patent: Jul. 25, 1989

[54] SERVICING DEVICE FOR OIL WELL ROD PUMPS

[76] Inventor: Douglas S. Petrie, 9003-93rd Ave., Fort St. John, B.C., Canada, V1J 4T9

[21] Appl. No.: 176,280

[22] Filed: Mar. 31, 1988

[51] Int. Cl.[4] ..... F16B 1/00; E21B 17/02

[52] U.S. Cl. ..... 403/344; 403/289; 166/72

[58] Field of Search ..... 403/289, 334, 344; 24/19, 279, 21, 22; 166/72, 75.1

[56] References Cited

U.S. PATENT DOCUMENTS

| | | | |
|---|---|---|---|
| 573,491 | 12/1896 | Smith | 24/279 |
| 3,633,246 | 1/1972 | Kirpatrick | 24/19 |
| 4,286,656 | 9/1981 | Felder | 166/75.1 |
| 4,502,189 | 3/1985 | Sieberkrob et al. | 24/279 |
| 4,541,145 | 9/1985 | Sato et al. | 24/19 |

FOREIGN PATENT DOCUMENTS

| | | |
|---|---|---|
| 530257 | 9/1956 | Canada . |
| 900843 | 5/1972 | Canada . |
| 995131 | 8/1976 | Canada . |

*Primary Examiner*—Randolph A. Reese
*Assistant Examiner*—Carol Bordas
*Attorney, Agent, or Firm*—Sixbey, Friedman, Leedom & Ferguson

[57] ABSTRACT

In accordance with the present invention there is provided a device for use in servicing an oil well rod pump. The pump has a rod string with a rod clamp secured thereto above the polish rod. The device comprises an elongated, weight-supporting polish rod-receiving cylindrical sleeve. The inner diameter of the sleeve is greater than the diameter of the polish rod. A slot in the side of the sleeve extends along its length. The width of the slot is slightly greater than the diameter of the polish rod. A flange extends outwardly from each side of the slot. Releasable securing means extend between the flanges to secure the sleeve in position about the polish rod. The sleeve is to receive, resting thereon when in position about the polish rod, the rod clamp to permit servicing work on the pump above the rod clamp. In using the device according to the present invention, it is no longer necessary to unclamp and reposition the lower rod clamp on the polish rod, and then reposition it after servicing of the pump equipment. Scarring of the working part of the polish rod due to clamping is avoided. At the same time, the task of readying an oil well pump for servicing is greatly simplified and the time for so doing is greatly reduced.

3 Claims, 1 Drawing Sheet

SERVICING DEVICE FOR OIL WELL ROD PUMPS

BACKGROUND OF THE INVENTION

The present invention relates to a device to facilitate the servicing of oil well rod pumps.

A conventional oil well pump used in pumping oil from an operating well consists primarily of a horizontal main beam or shaft which pivots in the center (like a teeter totter) with one end of the main beam being driven up and down by a motor. The other end of the main beam, or "head", has attached to it a steel rod known as a "polish rod" which is moved up and down in the valve mechanism of the oil well by the head of the main beam moving through an arc of approximately 10 feet on each reciprocation of the main beam.

At its lower end, the polish rod is restrained from moving too deeply into the well head by a collar-type clamp. At its upper end, the polish rod is attached to the head of the main beam by a hinged, U-shaped bridle and by a second clamp. The bridle allows the polish rod to constantly remain in a vertical position while it is moved up and down in the oil well valve mechanism.

In order to service the bridle, rod or motor powering the beam, it is essential that the weight of the rod string be supported. Conventionally, it is supported by moving the clamps on the bridle and the lower end of the polish rod so that the lower clamp ultimately rests on the oil well valve, thereby supporting the entire weight of the rod string. This creates problems since the surface of the polish rod must be kept extremely smooth because of the manufacturing tolerances between the polish rod and the oil well valve through which it reciprocates. The movement of the clamps and the necessity of securing them tightly against this smooth, lubricated surface of the polish rod in order to bear the entire weight of the rod string inevitably causes scarring and deformation of the polish rod surface. This action in turn rapidly damages the oil well valve mechanism and its packing, requiring frequent replacement thereof. An additional problem with using such clamps to hold the weight of the rod string of the oil well pump is that the clamps may slip, allowing the polish rod to fall into the oil well valve mechanism, causing both damage to the oil well valve mechanism and a substantial safety problem for servicing personnel.

Canadian Pat. No. 900,843 of Lodynski issued May 23, 1972, of general background interest, describes and illustrates an hydraulic cylinder apparatus which is attached to the polish rod of an oil well pump to permit controlled movement of that rod and assist in setting the suspension means of a deep well pump installation during operation. Canadian Pat. No. 530,257 describes and illustrates a polish rod clamp and Canadian Pat. No. 995,131 describes and illustrates a cable device to remove parts from a polish rod.

It is an object of the present invention to provide a device which may be used in servicing such an oil well pump which will avoid the requirement of undoing and relocating clamps on the polish rod to permit servicing to take place.

SUMMARY OF THE INVENTION

In accordance with the present invention there is provided a device for use in servicing an oil well rod pump. The pump has a rod string with a rod clamp secured thereto above the polish rod. The device comprises an elongated, weight-supporting polish rodreceiving cylindrical sleeve. The inner diameter of the sleeve is greater than the diameter of the polish rod. A slot in the side of the sleeve extends along its length. The width of the slot is slightly greater than the diameter of the polish rod. A flange extends outwardly from each side of the slot. Releasable securing means extend between the flanges to secure the sleeve in position about the polish rod. The sleeve is to receive, resting thereon when in position about the polish rod, the rod clamp to permit servicing work on equipment such as the bridle, main shaft, head or motor, above the rod clamp.

In a preferred embodiment of the present invention a cap, which is provided at the end of each sleeve, has a central circular rod-receiving hole and, communicating therewith, a rod-receiving slot coincident with that of the sleeve.

It will be understood that, in using a device in accordance with the present invention, the various rod clamps do not need to be moved to service the various parts of the equipment, thereby avoiding the type of damage to the polish rod which had occurred previously, when moving the rod clamps to service the equipment. The use of the device according to the present invention also forestalls the possibility of the polish rod and the valves to which it is attached being dropped into the inground portion of the oil well as would occur for example if both rod clamps were to slip while being moved. Because use of the device according to the present invention minimizes scarring of polish rods, it leads to decreased stuffing box packing wear. There is also a substantial saving of time in the servicing of each well, which allows the well to be back in production quickly, in using the device according to the present invention.

BRIEF DESCRIPTION OF THE DRAWINGS

These and other objects and advantages of the invention will become apparent upon reading the following detailed description and upon referring to the drawings in which.

Figure 1:
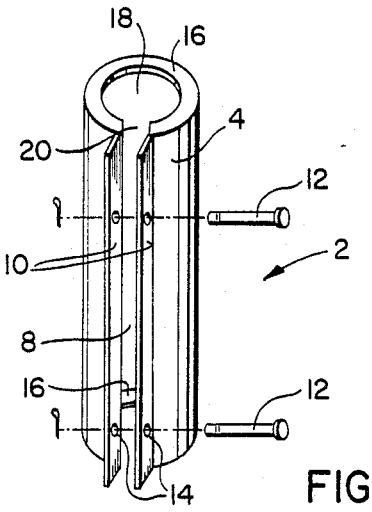
FIG. 1 is a perspective view of a device in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar reference numerals.

Turning to the drawings, there is illustrated in FIG. 1 a rod saver device 2 in accordance with the present invention, the device comprising a sleeve 4 adapted to carry fairly significant weights. The sleeve is of elongated, cylindrical construction and has an inner diameter which is greater than the diameter of the polish rod 6 (FIG. 2) about which it is to fit. An elongated slot 8 extends along the length of sleeve 4 in its side, the width of the slot being slightly greater than the diameter of polish rod 6. A pair of confronting flanges 10 extend outwardly, as illustrated, from each side of slot 8. Pins 12 are releasably securable, as illustrated, through aligned holes 14 in flanges 10 to hold device 2 in position on polish rod 6 when in use.

To the ends of sleeve 4 are secured end caps 16, each of the caps having a central circular, polish rod-receiving hole 18 and a slot 20 communicating therewith, slot 20 having a width similar to that of slot 8 and being aligned therewith.

In this manner, device 2 can be pushed into place around polish rod 6 and secured by pins 12.

Figure 2:
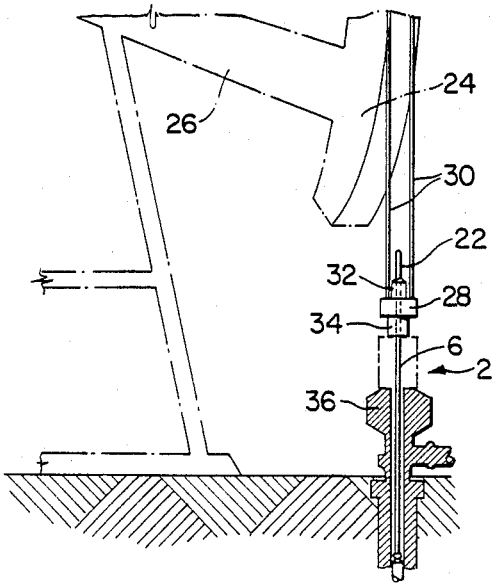
FIG. 2 is a schematic elevation view of the head portion of an oil well rod pump, to a portion of which the device of FIG. 1 has been fitted, to illustrate the manner of use of that device.

As seen in FIG. 2, rod string 22, of which polish rod 6 is a portion, is suspended from and driven by the head 24 at the front of main beam 26 of the oil well pump. This is accomplished by means of carrier bar 28, secured to head 24 by means of rods 30. The weight of rod string 22 is on carrier bar 28. Upper rod clamp 32 and lower rod clamp 34 secure rod string 22 to carrier bar 28 and prevent the possibility of polish rod 6 being dropped into the inground portion of an oil well when secured in position. Rod string 22, at polish rod portion 6, extends into the oil well through stuffing box 36.

As previously indicated, to service oil well pump equipment located above lower rod clamp 34, lower rod clamp 34 previously had to be undone and moved down the polish rod to a position immediately above stuffing box 36 where it would be resecured. The rod string 22 would then be lowered until this clamp 34 was resting on stuffing box 36 and service work above clamp 34 then carried out. When the service work was completed, lower rod clamp 34 would then be repositioned at its original position.

When a device 2 is used in accordance with the present invention, polish rod 6 is inserted into sleeve 4 between clamp 34 and stuffing box 36. Rod string 22 is then lowered until clamp 34 rests on the upper cap 16 of sleeve 4. In this manner, the rod string weight is on device 2. Servicing may then be carried on above clamp 34 in the usual manner. As well, as previously stated, use of the device according to the present invention has significantly reduced stuffing box packing wear which previously occurred because of scarred polish rods.

Because, in using the device according to the present invention, it is no longer necessary to unclamp and reposition lower rod clamp 34 on polish rod 6, and then reposition it after servicing of the pump equipment, scarring of the working part of polish rod 6 due to clamping is avoided. As well, where the rod string 22 must be unclamped so that it is no longer supported by carrier bar 28, since lower rod clamp 34 remains clamped in position, the likelihood of clamp 34 slipping to allow the polish rod 6 to fall into the oil well valve mechanism is significantly reduced. At the same time, the task of readying an oil well pump for servicing is greatly simplified and the time for so doing is greatly reduced.

Thus it is apparent that there has been provided in accordance with the invention a servicing device for oil well rod pumps that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A device for use in servicing an oil well rod pump, the pump having a rod string with a rod clamp secured thereto above the polish rod, the device comprising an elongated, weight supporting, polish rodreceiving cylindrical sleeve, the inner diameter of the sleeve being greater than the diameter of the polish rod, a slot in the side of the sleeve extending along its length, the width of the slot being slightly greater than the diameter of the polish rod, a flange extending outwardly from each side of the slot, a cap formed on each end of the sleeve and extending laterally inwardly beyond the inner diameter of the sleeve, said caps defining an opening at each end of the sleeve which is smaller in diameter than the inner diameter of the sleeve, but of a diameter no less than the diameter of the polish rod, and releasably securing means when in position extending between the flanges to secure the sleeve in position about the polish rod, the sleeve to receive, resting on one of said caps when said sleeve is in position about the polish rod, the rod clamp to permit service work on the pump above the rod clamp.

2. A device according to claim 1 wherein the securing means comprises pins releasably securable to extend between the flanges through aligned holes therein.

3. A device according to claim 2, wherein each of said caps is formed to define a cap slot aligned with the slot in said sleeve, said pins operating to close the cap slots and the slot in the side of said sleeve, said caps defining circular openings having a diameter which is greater than the diameter of said polish rod when said cap slots and the slot in the side of said sleeve are closed.

* * * * *